US005860627A

United States Patent [19]

Edwards

[11] Patent Number: 5,860,627

[45] Date of Patent: Jan. 19, 1999

[54] DEVICE FOR STORING AND TRANSPORTING TUBE SCAFFOLDING

[76] Inventor: David G. Edwards, 165 Hillmont Dr., Paducah, Ky. 42003

[21] Appl. No.: 967,926

[22] Filed: Nov. 12, 1997

Related U.S. Application Data

[60] Provisional application No. 60/030,913 Nov. 14, 1996.

[51] Int. Cl. [6] ..... F16L 3/22

[52] U.S. Cl. ..... 248/68.1; 138/112; 206/443

[58] Field of Search ..... 248/68.1; 211/60.1, 211/194, 59.4; 138/112; 165/162, 172; 206/443

[56] References Cited

U.S. PATENT DOCUMENTS

| | | | |
|---|---|---|---|
| 1,245,607 | 11/1917 | Maxwell . | |
| 1,793,059 | 5/1931 | Chambers . | |
| 1,993,216 | 11/1935 | Marshall . | |
| 3,502,227 | 3/1970 | Konstant et al. | 211/194 |
| 3,504,404 | 4/1970 | Rehnström et al. . | |
| 3,722,701 | 3/1973 | Malcik et al. | 211/194 |
| 3,945,497 | 3/1976 | Greenberg | 211/194 X |
| 4,099,626 | 7/1978 | Magnussen, Jr. | 248/68.1 X |
| 4,378,923 | 4/1983 | Takei . | |
| 4,769,985 | 9/1988 | Moritz . | |
| 5,098,047 | 3/1992 | Plumley | 248/68.1 |
| 5,188,319 | 2/1993 | Hawash et al. . | |
| 5,723,819 | 3/1998 | Kirma et al. | 248/68.1 |

FOREIGN PATENT DOCUMENTS

| | | | |
|---|---|---|---|
| 2420446 | 11/1979 | France . | |
| 272392 | 3/1951 | Switzerland | 248/68.1 |
| 1689153 | 11/1991 | U.S.S.R. . | |

*Primary Examiner*—Ramon O. Ramirez
*Attorney, Agent, or Firm*—Richard C. Litman

[57] ABSTRACT

A device for storing and transporting tube scaffolding which is comprised of a U-shaped cradle and an attachable closure member. The cradle is constructed from square tubing and is made up of a horizontal member and two vertical members which extend upward from and at right angles to the horizontal members to form an approximate U-shape. The closure member is a rigid rectangular plate which extends across the top of the cradle member and attaches thereto with a bolt and pin assembly. Alternatively, the closure member may rotate and lock into position with a pair of bolts. When in use, a pair of the devices are used together by stacking the tube scaffolding in the cradles of the devices so that the cradle members are adjacent the opposite ends of the tube scaffolding. Once a twenty-five count of tube scaffolding has been placed in the cradles, the closure members are attached to the cradles to secure the tube scaffolding in place.

10 Claims, 3 Drawing Sheets

DEVICE FOR STORING AND TRANSPORTING TUBE SCAFFOLDING

CROSS-REFERENCE TO RELATED APPLICATION

This application claims the benefit of U.S. Provisional Patent application Ser. No. 60/030,913, filed Nov. 14, 1996.

BACKGROUND OF THE INVENTION

1. Field of the Invention

The present invention relates to a device for storing and transporting tube scaffolding and, more specifically to a device for storing and transporting tube scaffolding which includes a U-shaped cradle member and an attachable closure member.

2. Description of the Related Art

In the building and construction industry, there exists a need to store and transport large quantities of elongated building material such as tube scaffolding. Due to the scale of some building and construction operations, it is desirable to make this as efficient and economical as possible, and even seemingly minor differences in the equipment used to do this can, in fact, be quite significant. This is illustrated by the fact that several devices for storing such materials have been disclosed in previous patents.

Previous U-shaped cradle devices for storing and transporting large numbers of pipes or other elongated materials such as loads of lumber, raw logs, or bundles of wires or tubing having described in the patent literature. None however use a rigid closure or are drawn to specifically handle bundles of standard sized diameter tube scaffolding.

U.S. Pat. No. 4,378,923, issued Apr. 5, 1983 to Isao Takei, shows a device which is placed at opposite ends of a number of elongated pipes to bind them for storage and transportation purposes. The device has top and bottom pipe holding members with concave recesses formed therein which are sandwiched around the pipes so that they are held in spaced relationship to each other to avoid damage during transportation. The above described device is adapted to store and transport pipes with protective coatings which are susceptible to damage during transport.

U.S. Pat. No. 1,793,059 (Chambers) and U.S. Pat. No. 1,993,216 (Marshall) show devices for transporting large quantities of cylindrical pipe in which the pipes are stacked within a U-shaped cradle and secured therein by a flexible closure strap.

U.S. Pat. No. 1,245,607, issued Nov. 6, 1917 to Ralph S. Maxwell, shows a lumber binding device with a U-shaped cradle portion and a rigid closure member that may be moved vertically within the cradle by a chain and pulley assembly.

U.S. Pat. No. 3,504,404, issued Apr. 7, 1990 to Knut Yngve Rehnström and Per Ablin Strombeck, shows a device with a U-shaped cradle member with an adjustable and releasable vertical member and a chain closure member for handling stacks of cut lumber.

Soviet document number 1,689,153 and French document number 2,420,446 show devices for transporting large elongated materials such as logs within wheeled U-shaped cradle members.

U.S. Pat. No. 4,769,985 (Moritz) and U.S. Pat. No. 5,188,319 (Hawash et al.) show devices with U-shaped cradle members and attachable closure members which are adapted to hold electrical cable, and small hoses and tubing.

Despite previous efforts, the need still exists for an inexpensive, simple device for storing and transporting tubular scaffolding, especially scaffolding having the approximate diameter of 1.9 inches.

None of the above inventions and patents, taken either singularly or in combination, is seen to describe the instant invention as claimed. Thus a device for storing and transporting tube scaffolding solving the aforementioned problems is desired.

SUMMARY OF THE INVENTION

The present invention is a device for storing and transporting tube scaffolding which is comprised of a U-shaped cradle and an attachable closure member. The cradle is constructed from square tubing and is made up of a horizontal member and two vertical members which extend upward from, and at right angles to, the horizontal members to form an approximate U-shape. The closure member is a rigid rectangular plate which extends across the top of the cradle member and attaches thereto with a bolt and pin assembly. When in use, a pair of the devices are used together by stacking the tube scaffolding in the cradles of the devices so that the cradles are adjacent the opposite ends of the tube scaffolding. Once a twenty-five count of tube scaffolding has been placed in the cradles, the closure members are attached to the cradles to secure the tube scaffolding in place.

Accordingly, it is a principal object of the invention to provide a device for storing and transporting tube scaffolding which is comprised of a U-shaped cradle and an attachable closure member.

It is another object of the invention to provide a device for storing and transporting tube scaffolding which is adapted to hold a twenty-five count of tube scaffolding.

It is a further object of the invention to provide a device for storing and transporting tube scaffolding with a closure member that is quickly and easily attached.

It is an object of the invention to provide improved elements and arrangements thereof in a device for storing and transporting tube scaffolding for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
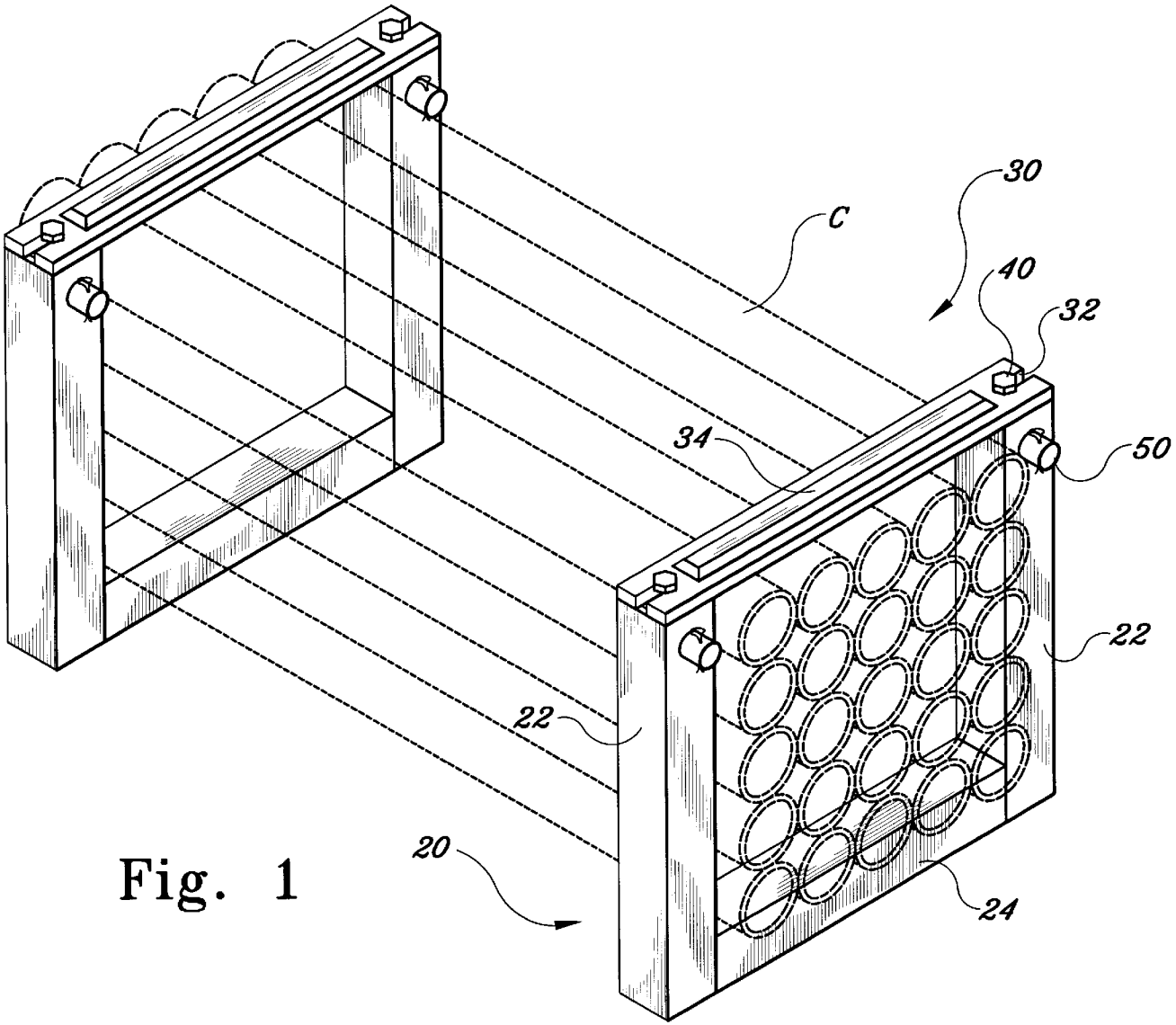
FIG. 1 is an environmental perspective view of the device for storing and transporting tube scaffolding.

Referring to the drawings, FIG. 1 illustrates the device for storing and transporting tube scaffolding C which includes a U-shaped cradle 20 and a closure member 30 which attaches to the top thereof. The cradle 20 is made up of a horizontal member 24 and two vertical leg members 22 all of which are preferably made from square tubing. The longitudinal ends of the horizontal member 24 are joined to the sides of the leg members 22 adjacent their bottom ends so that the vertical members extend upward from the horizontal member 24 at right angles to the horizontal member 24 and parallel to each other. The leg members 22 may be welded to the ends of the horizontal member 24 or formed integrally therewith so that the cradle 20 is formed from a single piece of material.

The horizontal member 24 is preferably about 9.75 inches in length and the leg members 22 are preferably about 11.5 inches in length so that when the horizontal member 24 and leg members 22 are joined they will define a U-shaped cradle 20 which is preferably 9.75 inches in width and 9.5 inches in height. When the cradle 20 has these dimensions, a horizontal row of five pieces of 1.9 inch diameter tube scaffolding C may be laid perpendicularly across the top of the horizontal member 24 between the two leg members 22 so that there is very little space between the pieces of tube scaffolding. Five horizontal rows of five pieces of 1.9 inch diameter tube scaffolding C may be stacked in the cradle 20 with these dimensions so that the bottom surface of the closure member 30 will contact the top surface of the pipes when secured to the top of the cradle 20.

Figure 3:
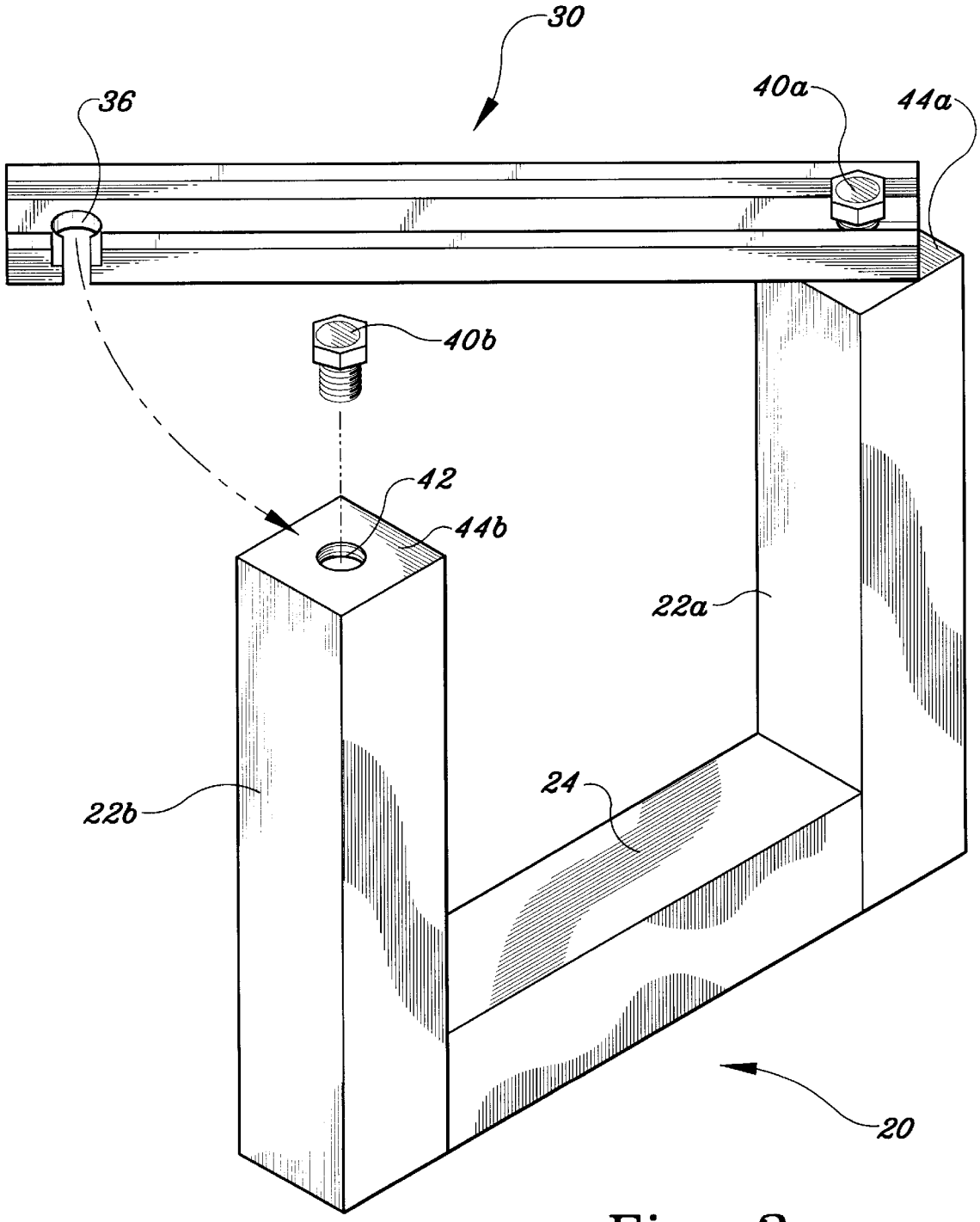
FIG. 3 is a perspective view of an alternative embodiment of the device for storing and transporting tube scaffolding.

The closure member 30 is a rectangular plate, the length of which extends from the opposite outside edges of the two leg members 22 and the width of which is equal to the width of the two leg members 22. Alternatively, the closure member 30 may be a rectangular member having a channel, as seen in FIG. 3, rather than a rectangular plate. The closure member 30 shown in FIG. 1 has two slots 32 formed therethrough from its top surface to its bottom surface. The slots 32 extend perpendicularly from the ends of the closure member 30 to a position which will be centered over the cross sectional centers of the leg members 22 when the closure member 30 is attached to the top thereof. The closure member 30 also has a rib 34 attached to or formed integrally on the top surface of thereof to strengthen the closure member 30. The rib 34 extends along the longitudinal center of the closure 30 and the ends of the rib 34 are disposed a small distance from the slots 32.

Figure 2:
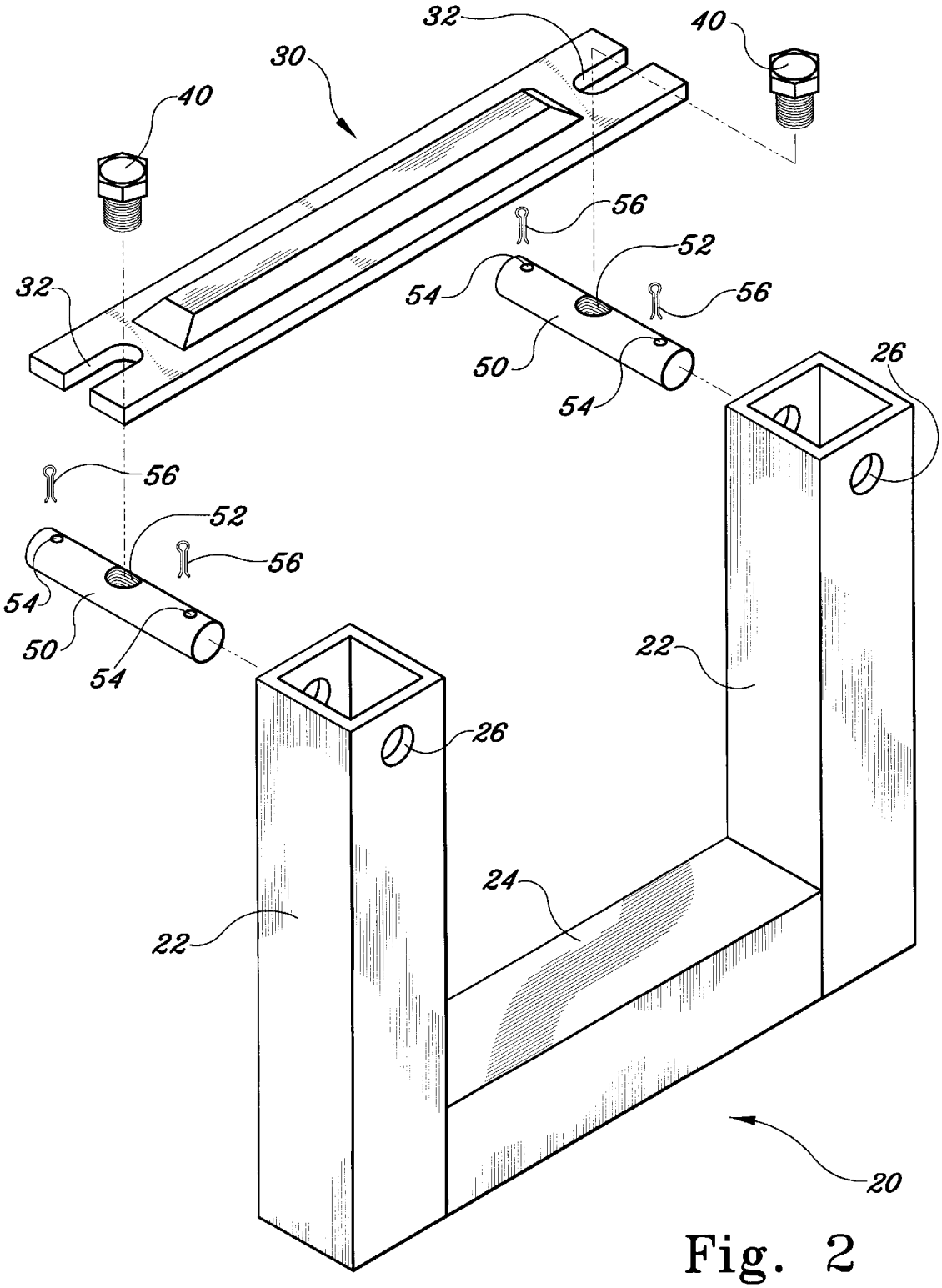
FIG. 2 is an exploded perspective view of the device for storing and transporting tube scaffolding.

The closure member 30 is attached, as shown in FIG.2, to the top ends of the leg members 22 by means of two bolts 40 and two pins 50. Each leg member 22 has a hole 26 drilled horizontally therethrough adjacent its top end. The holes 26 are drilled through the leg members 22 at a right angle to the horizontal member 24 and parallel to the tube scaffolding which is to be held therein. The pins 50 are solid cylinders having a diameter slightly less than the diameter of the holes 26 and having a length slightly greater than the cross sectional width of the leg members 22. Each pin 50 has two key holes 54 formed therethrough adjacent the opposite ends thereof. Each pin 50 also has a bolt hole 52 formed therethrough in the longitudinal center thereof.

To attach to closure member 30 to the top of the leg members 22, the pins 50 are inserted through the holes 26 in the vertical members so that the bolt hole 52 is vertically disposed in the cross sectional center of the vertical member 22 and the key holes 54 are disposed a small distance outside of the leg members 22. Then four cotter keys 56 are inserted through the key holes 54. The cotter keys 56 are adapted to be inserted through the key holes 54 so that they extend from the ends of the key holes 54 and are held in that position by frictional forces. The cotter keys 56 extend from the surface of the pins 50 to prevent them from being pulled or pushed through the holes 26.

Once the pins 50 have been attached to the leg members 22, as described above, the closure member 30 is placed on top of the vertical members so that the slots 32 are aligned over the bolt holes 52. Then the bolts 40 are screwed into the bolt holes 52 until the head of the bolt 40 clamps against the top surface of the closure member 30 thereby securing it in place. This can be seen in FIG. 2.

An alternative closure member 30 and manner of attaching it are shown in FIG. 3. The leg members 22*a*, 22*b* of the U-shaped cradle are topped by a plate 44*a*, 44*b* having a centrally located bolt hole 42. The closure member 30 may still be either a rectangular plate or channel member, the length of which extends from the opposite outside edges of the two leg members 22*a*, 22*b* and the width of which is equal to the width of the two leg members 22*a*, 22*b*. The closure member 30 has two ends, the first of which has an aperture formed therethrough in a position which will be centered over the centrally located bolt hole of the first leg member 22*a*. The opposite second end of the closure member 30 is provided with a slot 36 having a closed end coinciding with the centrally located bolt hole 42 of the second leg member 22*b*. This slot 36 runs perpendicular to the length of the closure member 30 where it opens on one side.

In this embodiment, the first end of the closure member 30 is attached to the top plate 44*a* of the first leg 22*a* of the U-shaped cradle 20 by a bolt 40*a*. In this manner, the closure member 30 may rotate about the bolt 40*a*. A second bolt 40*b* is threaded and received in the bolt hole 42, matingly threaded, of the remaining leg 22*b*. The closure member 30 may then be rotated into position such that the bolt 40*b* passes through the slot 36, and then may be secured. In this embodiment, the user need not worry about losing pieces of the device, because no piece need be completely removed.

Since a 9/16 inch bolt is used in assembling tube scaffolding, it is preferable that all bolts, and corresponding bolt holes, be of that size. This prevents workers from having to carry additional tools, while also insuring that each worker on a job site will have the appropriate tool to assemble the device and the scaffolding.

When used to store or transport tube scaffolding C, a twenty five count of 1.9 inch diameter tube scaffolding C is stacked in a pair of cradles 20 so that the cradles 20 are disposed adjacent the opposite ends of the tube scaffolding C, and then the closure 30 is secured in the fashion described above to secure the tube scaffolding within the cradles 20.

It is to be understood that the present invention is not limited to the embodiments described above, but encompasses any and all embodiments within the scope of the following claims.

I claim:

1. A device for storing and transporting a multiplicity of tube scaffolding having a wall defining a standard diameter and being of various lengths, said device comprising:

a pair of U-shaped cradles, each of said cradles comprises hollow squared tubing and further comprising:

a horizontal base member dimensioned in length to hold five standard diameter scaffold tubes laid wall to wall, and a first and a second leg member, each having an upper end and extending vertically upwards, each said leg member including a hole near said upper end and passing completely through each said leg member perpendicular to the plane of said U-shaped cradle, each said leg member further having a height sufficient to hold five standard diameter scaffold tubes when stacked upon one another upon said horizontal base;

a pair of corresponding closure members, each of said closure members spanning said U-shaped cradle from said upper end of said first leg member to the upper end of said second leg member, each of said closure members further comprise a rectangular plate, having a top surface, a bottom surface, a first end and a second end, each end defining a slot extending perpendicularly from each end a distance coinciding with a midpoint atop each said leg member;

a means for attaching each of said closure members atop of each said leg member, said means includes:

two pins, each having opposite ends and being a solid cylinder which passes completely through and beyond said hole of each said leg member, each of said pins having key holes adjacent said opposite ends and a threaded bolt hole formed through its longitudinal center;

a pair of cotter keys respectively passing through said key holes of each of said pins a bolt having a head portion and a bolt portion, said bolt portion having a diameter less than the width of each said slot in each of said closure members and threadably engaging said bolt hole of each of said pins, whereby said head portion secures said closure member upon tightening.

2. The device as recited in claim 1 wherein said device is dimensioned and configured for scaffold tubes having a standard diameter of about 1.9 inches.

3. The device as recited in claim 1 wherein said device is dimensioned and configured for scaffold tubes having a standard diameter of about 1.9 inches.

4. The device as recited in claim 1, wherein said closure member further includes a reinforcing rib, said reinforcing rib protruding from the top surface of said closure member and running long the longitudinal center thereof.

5. The device as recited in claim 1, wherein said bolts and corresponding bolt holes are sized to match the standard sized bolts used in assembling the scaffolding.

6. The device as recited in claim 5, wherein said bolts and corresponding bolt holes are 9/16 inch.

7. A device for storing and transporting a multiplicity of tube scaffolding having a wall defining a standard diameter and being of various lengths, said device comprising:

a pair of U-shaped cradles, each of said cradles further comprising:

a horizontal base member dimensioned in length to hold five standard diameter scaffold tubes laid wall to wall, and a first and a second leg member, each said leg member having an upper end and extending vertically upwards and further comprises a closed upper end having a centrally located threaded bolt hole, each said leg member having a height sufficient to hold five standard diameter scaffold tubes when stacked upon one another upon said horizontal base;

a pair of corresponding closure members, each of said closure members spanning said U-shaped cradle from said upper end of said first leg member to the upper end of said second leg member, each of said closure members is rectangular, sized to complement said U-shaped cradle, each of said members having a first end and a second end, said first end defining an aperture coinciding with said centrally located bolt hole of said first leg member, said second end defining a slot, having a closed end coinciding with said centrally located bolt hole of said second leg member, said slot running perpendicular to the length of each of said closure members to an opening on one side;

a means for attaching each of said closure members atop each said leg member, said means includes:

a first bolt passing through said aperture and threadably engaging said bolt hole of said first leg member for securing the first end of each of said closure members, and a second bolt passing through said slot and threadably engaging said bolt hole of said second leg member for securing the second end of each of said closure members.

8. The device as recited in claim 7 wherein said device is dimensioned and configured for scaffold tubes having a standard diameter of about 1.9 inches.

9. The device as recited in claim 7, wherein each of said bolts and corresponding bolt holes are sized according to industry standards of bolts used in assembling the scaffolding.

10. The device as recited in claim 9, wherein said bolts and corresponding bolt holes are 9/16 inch.

* * * * *